United States Patent [19]

Fisher

[11] 4,134,673

[45] Jan. 16, 1979

[54] DUAL BRUSH CLEANING APPARATUS

[75] Inventor: Donald J. Fisher, Pittsford, N.Y.

[73] Assignee: Xerox Corporation, Stamford, Conn.

[21] Appl. No.: 553,759

[22] Filed: Feb. 27, 1975

[51] Int. Cl.[2] ..... G03G 21/00

[52] U.S. Cl. ..... 355/15; 15/256.52

[58] Field of Search ..... 355/15; 15/256.5, 256.51, 15/256.52, 1.5

[56] References Cited

U.S. PATENT DOCUMENTS

| | | | |
|---|---|---|---|
| 2,124,008 | 7/1938 | Roth | 15/256.52 |
| 3,610,693 | 10/1971 | Solarek | 355/15 X |
| 3,741,157 | 6/1973 | Krause | 355/15 X |
| 3,784,297 | 1/1974 | Ito et al. | 355/15 X |
| 3,795,025 | 3/1974 | Sadamitsu | 355/15 X |
| 3,807,853 | 4/1974 | Hudson | 355/15 |

OTHER PUBLICATIONS

Abbott, T. D. "Adjustable Diameter Cleaning Brush" IBM Technical Disclosure Bulletin, vol. 14, No. 7, Dec. 1971, pp. 2010–2011.

*Primary Examiner*—Fred L. Braun

[57] ABSTRACT

The cleaning apparatus comprises a first cleaning brush arranged for brushing engagement with the imaging surface and a second cleaning brush arranged for brushing engagement with the imaging surface following the first cleaning brush. The first cleaning brush has a first brush to imaging surface interference. The second brush has a second brush to imaging surface interference which is greater than the first interference. In accordance with preferred embodiments the first interference has a magnitide of from about 20% to about 80% of the second interference.

10 Claims, 1 Drawing Figure

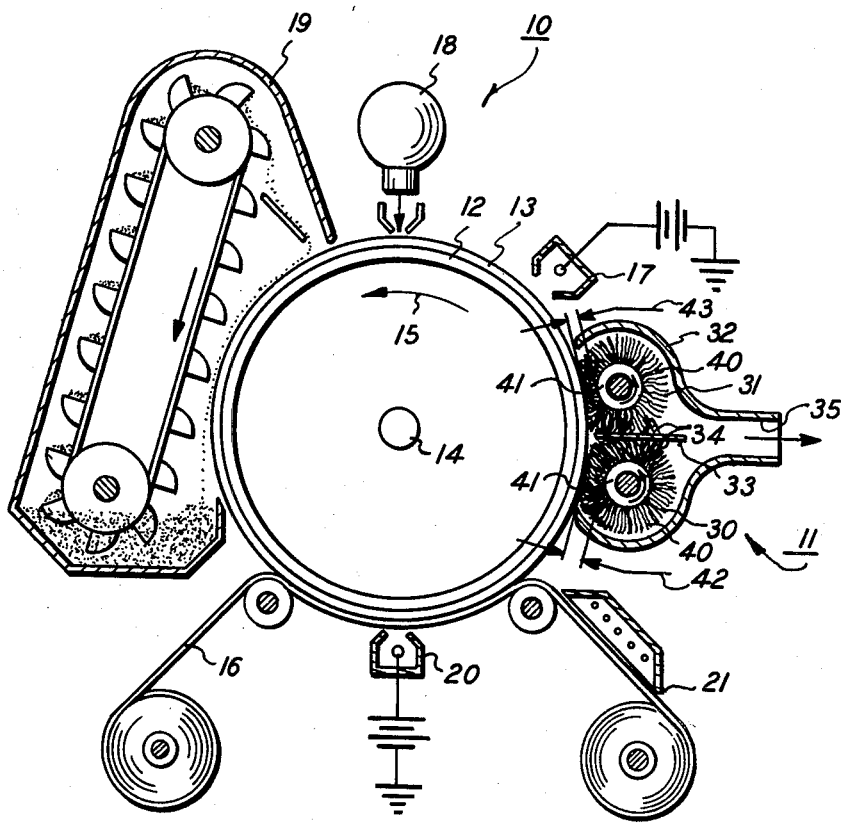
19
18
10
12
13
17
43
32
40
31
35
15
41
34
14
41
33
30
11
40
42
16
20
21

DUAL BRUSH CLEANING APPARATUS

BACKGROUND OF THE INVENTION

This invention relates to a dual brush cleaning apparatus, and more particularly to an apparatus for removing residual material from the surface of an electrostatographic imaging member. An electrostatographic reproducing machine employing the apparatus also forms part of this invention.

The use of dual brushes in a cleaning apparatus for removing residual material from the surface of an electrostatographic imaging member is known as shown, for example, in U.S. Pat. Nos. 3,062,178 to Huber; 3,062,956 to Codichini; and U.S. Pat. No. 3,795,025 to Sadamitsu.

Other cleaning systems have been proposed wherein more than one cleaning device is provided in order to have redundancy in the cleaning system. For example, U.S. Pat. No. 3,552,850 to Royka et al. discloses the use of multiple cleaning blades. In U.S. Pat. No. 3,859,691, to Katayama, a cleaning blade followed by a fabric roller is disclosed as an alternative to multiple blades. In U.S. Pat. No. 3,807,853 the use of multiple foam cleaning rolls is described.

In U.S. Pat. No. 3,741,157 to Krause, an air jet cleaning apparatus followed by a brush cleaner is described. It is noted in this patent that brush cleaning can result in filming of the photoconductor surface and other damage due to the continuous contact between the brush and the surface. Therefore, the combination of air jet cleaning and brush cleaning leads to an increase in the usable life of the photoconductor surface. It is pointed out that the air jet cleaning system does the main cleaning so the brush fibers do not have to transport as much toner as in a conventional brush cleaning system and, therefore, the brush can be rotated at a much slower speed than a conventional brush. The slower speed of the brush reduces local heating and deformation of the photoconductive surface so that there is a corresponding increase in the useful life of this member as compared to systems utilizing only brush cleaning.

It has been found in accordance with this invention that photoconductor filming due to brush cleaning is attributable at least in part to the build-up of residual toner in the cleaning brush. The brush becomes impacted with toner which then impacts on the photoconductor surface. Therefore, in accordance with this invention a means has been devised for reducing the build-up of residual toner in the brushes. In prior art, dual brush cleaning systems the brushes were normally operated at a brush to imaging surface interference which was the same for both brushes. The net result of this approach is that the first of the two brushes performs cleaning as if it were the only brush. The second brush in the direction of photoconductor travel cleans any residue which passes the first brush. This does not substantially reduce toner build-up in the first brush and it is likely to cause drum filming and poor cleaning at the same rate as a single brush.

SUMMARY OF THE INVENTION

Therefore, in accordance with this invention an improved dual brush cleaning apparatus is provided for removing residual material such as toner particles from the surface of an electrostatographic imaging member. An electrostatographic reproducing machine employing the apparatus also forms part of this invention.

In accordance with this invention the amount of interference between the fibers of each of the brushes is different. The interference of the first brushh is selected at a value which will provide less efficient cleaning of the toner from the photoconductor surface than a conventional cleaning brush. The second brush is then preferably set at a conventional interference so that it will efficiently clean all of the remaining residual material from the surface. In this manner, the toner cleaning is more evenly distributed between the brushes, and the toner build-up in the first brush should be substantially reduced as compared to prior art type dual brush cleaners. Therefore, it is expected that the interval during which the cleaning brush will be effective without filming the photoconductor surface will be substantially extended as compared to conventional single or dual brush cleaners.

The cleaning apparatus comprises a first cleaning brush arranged for brushing engagement with the imaging surface, and a second cleaning brush arranged for brushing engagement with the imaging surface following the first cleaning brush. The first cleaning brush as a first brush to imaging surface interference. The second brush has a second brush to imaging surface interference which is greater than the first interference. In accordance with preferred embodiments the first interference has a magnitude of from about 20% to about 80% of the second interference, and in a more preferred embodiment from about 40% to about 60% of the second interference.

An electrostatographic reproducing machine employing the above-noted apparatus is also contemplated in accordance with this invention having means for forming an electrostatic image on the surface and means for developing the electrostatic image to render it visible. Preferably, means are provided for transferring the developed image to a sheet of final support material.

Accordingly, it is an object of this invention to provide an improved dual brush cleaning apparatus with increased life before photoreceptor filming.

It is a further object of this invention to provide an apparatus as above wherein the brush to imaging surface interferences are selected to reduce brush filming.

It is a further object of this invention to provide an apparatus as above wherein the brush to imaging surface interference is greater for one brush than the other.

It is a still further object of this invention to provide an electrostatographic reproducing machine incorporating the above cleaning apparatuses.

These and other objects will become more apparent to those skilled in the art from the following description and drawings in which:

BRIEF DESCRIPTION OF THE DRAWING

The FIGURE is a schematic representation of an electrostatographic reproducing machine incorporating the improved brush cleaning apparatus in accordance with this invention.

DETAILED DESCRIPTION

Referring now to the FIGURE, there is shown by way of example an automatic xerographic reproducing machine 10 which incorporates the cleaning apparatus 11 of the present invention. The reproducing machine 10 depicted in the FIGURE illustrates the various components utilized therein for producing copies from an original document. Although the cleaning apparatus 11 of the present invention is particularly well adapted for use in an automatic xerographic reproducing machine 10, it should become evident from the following description that it is equally well suited for use in a wide variety of electrostatographic systems and it is not necessarily limited in its application to the particular embodiment or embodiments shown herein.

The reproducing machine 10 illustrated in the FIGURE employs an image recording drum-like member 12, the outer periphery of which is coated with a suitable photoconductive material 13. One type of suitable photoconductive material is disclosed in U.S. Pat. No. 2,970,906, issued to Bixby in 1961. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a web or sheet of final support material 16 such as paper or the like. While a drum has been illustrated, the image recording member could comprise a flat plate, belt, or web type member as desired.

The practice of xerography is well known in the art and is the subject of numerous patents and texts including *Electrophotography* by Schaffert, published in 1965, and *Xerography and Related Processes* by Dessauer and Clark, published in 1965.

Initially, the drum 12 moves the photoconductive surface 13 through a charging station 17. At the charging station, an electrostatic charge is placed uniformly over the photoconductive surface 13 preparatory to imaging. The charging may be provided by a corona generating device of the type described in U.S. Pat. No. 2,836,725, issued to Vyverberg in 1958.

Thereafter, the drum 12 is rotated to exposure station 18 wherein the charged photoconductive surface 13 is exposed to a light image of the original input scene information whereby the charge is selectively dissipated in the light exposed regions to record the original input scene in the form of a latent electrostatic image. A suitable exposure system may be of a type described in U.S. Pat. No. 3,062,110, issued to Shepardson et al. in 1962. After exposure, drum 12 rotates the electrostatic latent image recorded on the photoconductive surface 13 to development station 19 wherein a conventional developer mix including toner particles is cascaded over the photoconductive surface 13 rendering the latent image visible as a toner defined image.

The developed image on the photoconductive surface 13 is then brought into contact with web 16 of final support material within a transfer station 20 and the toner image is transferred from the photoconductive surface 13 to the contacting side of the web 16. The final support material may be paper, plastic, etc., as desired.

After the toner image has been transferred to the final support material 16, the web with the image thereon is advanced to a suitable fuser 21 which coalesces the transferred powder image thereto. One type of suitable fuser is described in U.S. Pat. No. 2,701,765, issued to Codichini et al. in 1955. After the fusing process the web 16 is advanced to a suitable output device.

Although a preponderance of the toner powder is transferred to the final support material 16, invariably some residual toner and other debris remains on the photoconductive surface 13 after the transfer of the toner powder image to the final support material. The residual toner particles remaining on the photoconductive surface 13 after the transfer operation are removed therefrom as the drum moves through the cleaning station 11. The toner particles are mechanically cleaned from the photoconductive surface 13 by the use of a dual brush cleaner as will be set forth in greater detail hereafter.

It is believed that the foregoing description is sufficient for purposes of the present application to illustrate the general operation of an automatic xerographic copier 10 which can embody the cleaning apparatus 11 in accordance with the present invention.

The drum cleaning station 11 is positioned downstream from the transfer station 20 and upstream of the charging station 17. If desired, the removed toner can be returned for reuse to the developer station 19 by any desired means.

The cleaning apparatus of this invention will now be described with reference to a preferred embodiment which includes a pair of cleaning brushes 30 and 31 located within and substantially enclosed by a brush cleaner housing 32 having an inlet opening positioned closely adjacent to the surface of the drum. The direction of rotation of the brushes 30 and 31 is the same as the direction of rotation of the drum 12; namely, counterclockwise. Therefore, the brushes at the nips they form with the imaging surface 13 rotate counter to the direction in which the surface is moving. However, if desired, any rotational direction could be employed such as the use of counter rotating brushes as set forth in the above noted Sadamitsu patent.

The brushes 30 and 31 are supported and driven by conventional means for rapid rotational brushing engagement with the surface 13 to be cleaned. A separating member 33 with flicker elements 34 is positioned between the brushes as in the Sadamitsu patent. The housing 32 includes a vacuum port 35 which may be connected to any desired source of suction (not shown) such as a conventional vacuum cleaner. The suction provides an air flow for carrying away toner and other material removed from the imaging surface. Other elements useful for dual brush cleaners may be provided as set forth in the above noted prior art patents.

The fibers 40 of the brushes 30 and 31 have a length respectively which is greater than the thickness of the respective gap 42 or 43 from the surface of the brush core 41 to the surface of the imaging member 12. The excess length of the brush fibers over the thickness of the respective gap defines the brush to imaging surface interference for each brush.

In the embodiment shown the gap 42 between the surface of the first brush 30 core and the surface 13 of the imaging member 12 is set wider than the gap 43 between the second brush 31 core and the surface of the imaging member, thereby providing a brush to drum interference for the first brush which is substantially less than the brush to drum intereference for the second brush. However, any desired approach could be employed for providing the differing interferences including for example the use of alternate brushes 30 and 31 with different fiber lenths, respectively.

Preferably, the brush to imaging surface interference for the first brush 30 is from about 20 to about 80% of the brush to imaging surface interference of the second brush, and most preferably from about 40 to about 60% of the second brush to imaging surface interference.

By utilizing a smaller brush to drum interference for the first cleaning brush 30 the first brush will only partially clean the toner from the surface 13 of the drum 12 and with a much gentler action. The brush to drum interference for the second brush is preferably set at a value usually employed for good cleaning with a single or dual brush cleaner. Therefore, the toner to be cleaned should be divided more evenly between the two brushes as compared to the prior art systems thereby extending the life of the brushes prior to filming of the imaging surface.

Any desired brush materials may be utilized in accordance with the present invention as set forth in the above noted patents. For example, fiber materials, furs and the like including synthetic fiber materials and natural fibers may be selected as desired in accordance with conventional prior art practice.

It is believed that in accordance with this invention the first brush 30 should be provided with a brush to imaging surface interference of from about 0.040 inches to about 0.080 inches, and that the second brush should be provided with a brush to imaging surface interference of from about 0.080 to about 0.160 inches. While the upper and lower limits respectively just described overlap, it should be apparent that the relationship between the brush to drum interferences for the respective first and second brushes should be maintained within the previously described percentage limits.

What is claimed is:

1. A cleaning apparatus for removing residual material from the surface of a moving electrostatographic imaging member, said apparatus comprising:

a first cleaning brush arranged for brushing engagement with said surface;

a second cleaning brush arranged for brushing engagement with said surface following said first brush;

said second brush having a desired brush to imaging surface interference and said first brush having a brush to imaging surface interference which is from about 20 to about 80% of the brush to imaging surface interference of said second cleaning brush;

each of said brushes comprising a core member and a plurality of brush fibers extending outwardly therefrom, a first gap being defined from said first brush core to said surface, and a second gap being defined from said second brush core to said surface, said first gap being larger than said second gap and said fibers of said first brush and said fibers of said second brush having substantially the same length;

whereby said first cleaning brush only partially removes said material from said surface to thereby divide the cleaning between said first and second brushes.

2. An apparatus as in claim 1 wherein, said first cleaning brush has a brush to imaging surface interference which is from about 40% to about 60% of the brush to imaging surface interference of said second cleaning brush.

3. An apparatus as in claim 2 wherein the interference of said first brush is from about 0.040 to about 0.080 inches and the interference of said second brush is from about 0.080 to about 0.160 inches.

4. An apparatus as in claim 3 wherein said first and second brushes comprise cylindrical brushes arranged for rapid rotation.

5. An apparatus as in claim 4 wherein said imaging surface comprises a cylindrical surface which is rotatable in the same direction as said brushes whereby said brush fibers as they contact said imaging surface move in a direction opposed to the direction in which said imaging surface is moving.

6. An electrostatographic reproducing apparatus comprising:

an imaging surface;

means for forming an electrostatic image on said surface;

means for developing said image to render it visible;

means for transferring said visible image to a sheet of final support material; and means for cleaning said surface;

the improvement wherein said cleaning means comprises:

a first cleaning brush arranged for brushing engagement with said surface;

a second cleaning brush arranged for brushing engagement with said surface following said first brush;

said second brush having a desired brush to imaging surface interference and said first brush having a brush to imaging surface interference which is from about 20% to about 80% of the brush to imaging surface interference of said second cleaning brush;

each of said brushes comprising a core member and a plurality of brush fibers extending outwardly therefrom, a first gap being defined from said first brush core to said surface, and a second gap being defined from said second brush core to said surface, said first gap being larger than said second gap and said fibers of said first brush and said fibers of said second brush having substantially the same length;

whereby said first cleaning brush only partially cleans said surface to thereby divide the cleaning between said first and second brushes.

7. An apparatus as in claim 6, wherein said first cleaning brush has a brush to imaging surface interference which is from about 40% to about 60% of the brush to imaging surface interference of said second cleaning brush.

8. An apparatus as in claim 7 wherein the interference of said first brush is from about 0.040 to about 0.080 inches and the interference of said second brush is from about 0.080 to about 0.160 inches.

9. An apparatus as in claim 8 wherein said first and second brushes comprise cylindrical brushes arranged for rapid rotation.

10. An apparatus as in claim 9 wherein said imaging surface comprises a cylindrical surface which is rotatable in the same direction as said brushes whereby said brush fibers as they contact said imaging surface move in a direction opposed to the direction in which said imaging surface is moving.

* * * * *